US005401899A

United States Patent [19]

Bryant et al.

[11] Patent Number: 5,401,899

[45] Date of Patent: Mar. 28, 1995

[54] PAPER MACHINE COATING SYSTEM

[75] Inventors: Wayne S. Bryant; James J. Masella, III, both of Clifton Forge, Va.

[73] Assignee: Westvaco Corporation, New York, N.Y.

[21] Appl. No.: 47,571

[22] Filed: Apr. 15, 1993

[51] Int. Cl.[6] ..... B05C 1/00

[52] U.S. Cl. ..... 118/603; 118/608; 118/610; 118/612; 210/167; 210/434; 210/805

[58] Field of Search ..... 118/602, 603, 610, 612, 118/608; 210/805, 808, 790, 434, 167; 162/265; 209/2, 30, 12, 268, 235

[56] References Cited

U.S. PATENT DOCUMENTS

| | | | |
|---|---|---|---|
| 3,001,228 | 9/1961 | Nack | 118/612 |
| 3,097,075 | 7/1963 | Vandenhoeck | 209/30 |
| 3,220,546 | 11/1965 | Gardner | 209/268 |
| 3,292,577 | 12/1966 | Cressey, Jr. et al. | 118/603 |
| 3,365,326 | 1/1968 | Conrad | 118/602 |
| 3,372,879 | 3/1968 | Jones et al. | 209/12 |
| 3,930,464 | 1/1976 | Wallstén | 118/122 |
| 3,933,577 | 1/1976 | Penque | 162/4 |
| 4,147,616 | 4/1979 | Balcar et al. | 209/12 |
| 4,267,060 | 5/1981 | Miller | 210/805 |
| 4,334,984 | 6/1982 | Vagac et al. | 209/12 |
| 4,405,450 | 9/1983 | Selder | 209/12 |
| 5,009,758 | 4/1991 | Okada et al. | 118/603 |
| 5,080,807 | 1/1992 | Carr et al. | 209/2 |
| 5,137,155 | 8/1992 | Jönsson et al. | 209/2 |
| 5,183,572 | 2/1993 | Benn | 210/790 |
| 5,285,903 | 2/1994 | Sorenson et al. | 210/805 |

OTHER PUBLICATIONS

*Pulp and Paper Manufacture,* 2nd Ed, vol II, 1969, McGraw-Hill Book Co., New York, pp. 457-513.

*Primary Examiner*—W. Gary Jones
*Assistant Examiner*—Laura E. Collins
*Attorney, Agent, or Firm*—J. R. McDaniel; R. L. Schmalz; W. A. Marcontell

[57] ABSTRACT

A low contaminant level is maintained in a high flow rate paper machine coating fluid circulation system by shunting a significant minority portion of the total flow through a full flow, atmospherically open, self-cleaning screen having a fine mesh screen cloth. Accept flow from the open screen is directed to the flow inlet of an entrained air purging apparatus for dispersing consolidated particulates of excessive size. Flow from the particulate disbursing apparatus is thereafter pumped through an enclosed pressure screen of moderate screen mesh.

18 Claims, 2 Drawing Sheets

PAPER MACHINE COATING SYSTEM

BACKGROUND OF THE INVENTION

1. Field of the Invention

The present invention relates to papermaking and, in particular, continuous circulation and supply systems for paper web coaters and size presses.

2. Description of the Prior Art

To enhance the printing qualities of paper and paperboard, one or both surfaces may be coated with a fluidized blend of finely particulated minerals and adhesive, dried and calendered. The predominate mineral constituent is coating clay blended with small quantities of calcium carbonate and/or titanium dioxide. This coating blend is traditionally applied to a traveling paper web by one of numerous coating application systems. Several of these coating application systems include a standing flow pond or channel of coating fluid confined on one side by the traveling web surface whereby the traveling web is drawn through the standing pond of coating material. Representative of such systems are blade coaters, roll coaters and air doctors. Supporting such an application system is a pumped circulation flow rate that may be ten times greater than the web surface application rate.

Although these flooded channel or standing pond application systems effectively transfer a substantially uniform distribution of coating fluid to the web surface, simultaneously, the web surface is being flushed of loose lint, fiber bundles and accumulated contaminants. Other foreign matter such as grit, ash, chips, string and bits of kraft or jute bags can be introduced to the coating fluid circulation system with the raw materials. Undispersed or oversize pigments and flocculated or undissolved adhesives can come from the coating preparation and dried coating may flake from the coating apparatus and fall back into the standing pond.

Foreign and contamination particles larger than 100 microns will cause coating streaks and blemishes with most application systems and particles larger than 45 microns may create blemishes with a blade coating apparatus. To control and remove such disruptive contamination, coating fluid circulation systems are provided with mixers, dispersion equipment and strainers or screens. Although helpful and even essential, the prior art screening devices are less than satisfactory. Selection and sizing are influenced by numerous factors such as system flow rate, fluid viscosity and acceptable particle size.

Totally enclosed pressure screens are preferred to avoid the air entrainment incident of atmospherically open screens. However, the finest screen mesh practical with a pressure screen is about 150 Tyler mesh (105 micron). Blade coating apparatus requires a 44 micron (325 Tyler mesh) acceptable particle size. Finer mesh pressure screens occasion unreasonably short plugging and cleaning cycles.

Atmospherically open, self-cleaning screens may be sized to accommodate a large flow rate and fine particle size. However, this type of screen also entrains air to foam the circulation system.

It is, therefore, an object of the present invention to provide a paper web coating fluid circulation system of high flow rate that is screened of most particles greater than 44 microns.

Another object of the present invention is to provide a 325 Tyler mesh screen for paper web coating systems.

Another object of the present invention is to provide a deaeration system for 325 Tyler mesh screened coating fluid.

SUMMARY OF THE INVENTION

These and other objects of the invention are accomplished by a coating fluid circulation system that includes a particle dispersion apparatus, a pressure screen of moderate screen mesh and an atmospherically open, self-cleaning screen of fine screen mesh.

Full flow from a coater or size press recovery pan is directed to high shear mixing and/or dispersion equipment such as a KADY MILL. From the dispersion apparatus, flow is divided between a coating applicator route, which includes moderate mesh pressure screens, and a feed back route which includes an atmospherically open, self-cleaning fine screen.

Flow rate through the open screen is usually less than half of the total flow but three to ten times greater than the total system make-up flow.

Accepts from the fine mesh open screen are returned to the dispersion apparatus feed conduit. Rejects from the open screen are sewered. Air entrained with the coating fluid while passing the open screen is stripped from the coating fluid in transit through the dispersion apparatus and pressure screen.

DESCRIPTION OF THE DRAWINGS

In reference to the drawings, like reference characters designate like or similar elements throughout the several drawing FIGURES.

DESCRIPTION OF THE PREFERRED EMBODIMENT

Figure 1:
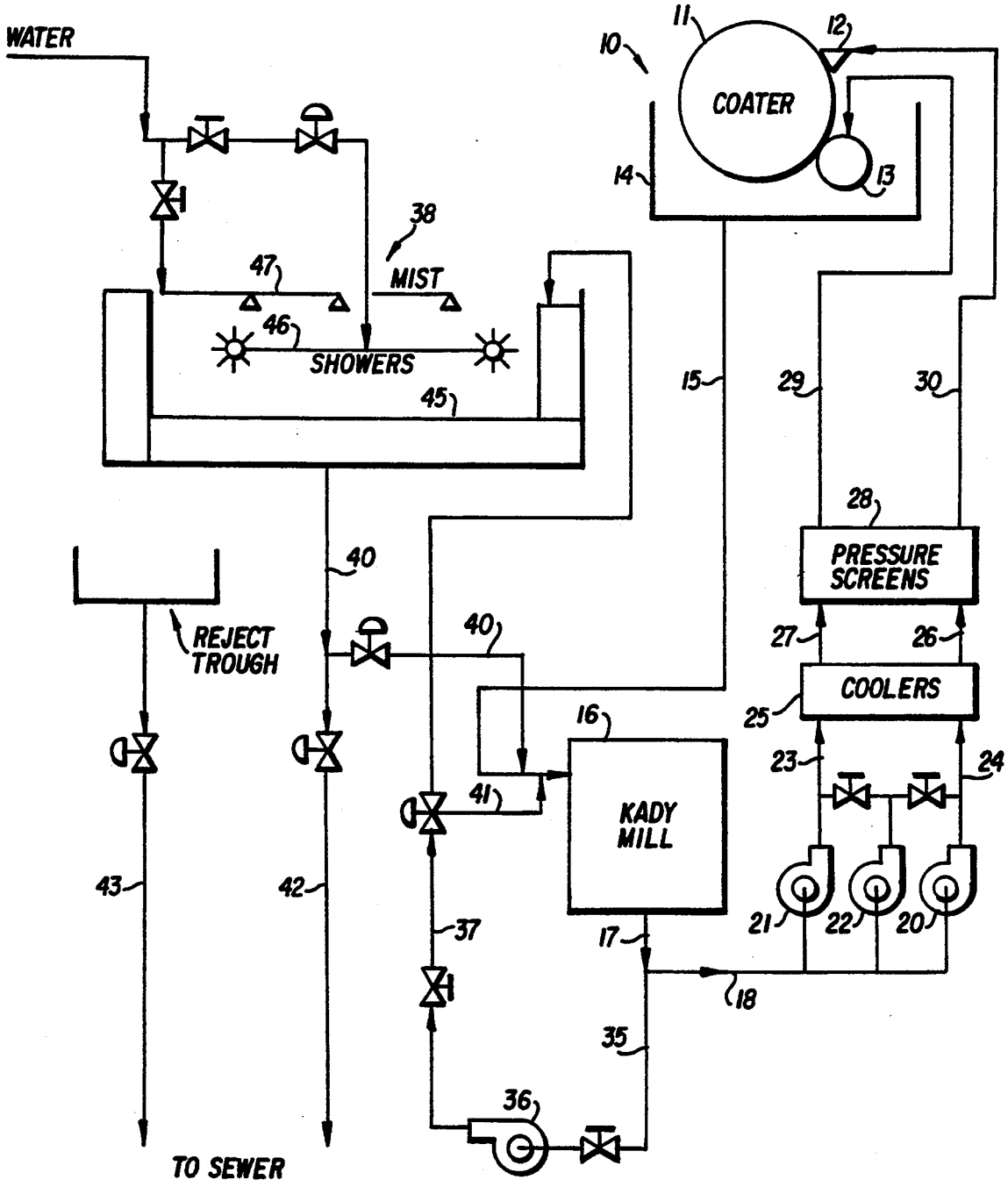
FIG. 1 is a line flow schematic of the present invention.

Referring now to the flow schematic of FIG. 1 and beginning with the coating apparatus 10 which includes a paper web wrap roll 11, a roll coater 13 and a blade coater 12. Beneath the web wrap roll assembly is a catch basin 14 to receive by-pass flow from the application units 12 and 13. This schematic will be understood as applicable to either coaters or size presses and for either on-machine or off-machine utility: "on-machine" meaning processing continuity with a paper machine.

A drain conduit 15 from the catch basin 14 channels the coater fluid by-pass into a dispersion unit 16 such as the product of Kinetic Dispersion Corp. known to the trade as a KADY MILL. Such equipment has a vaned stator and rotor. The by-pass coating fluid is drawn into a center rotor opening and released through perimeter slots. Very high angular velocities of the fluid leaving the rotor causes high shear force upon the fluid by an abrupt change of direction when the fluid engages the stator surfaces. This high shear force disperses consolidated beads and releases most entrained air drawn from the open screen accept line 40.

The KADY MILL outlet flow is divided between primary loop 18 and the open screen loop 35. A majority of the flow volume is directed to pumps 20 and 21: the pump 22 being a spare for either of the two primary supply lines.

High pressure discharge conduits 23 and 24 direct the respective flow streams through coolers 25 and, via conduits 26 and 27, through respective pressure screens 28. The most commonly used pressure screen design is a totally enclosed metallic screen "sock" of moderately fine weave being 100 to 150 Tyler mesh. The inlet side of the pressure screen 28 includes a sealed air vent not shown.

Pressure screen discharge lines 29 and 30 return the screened coating flow to the applicator units 12 and 13 for fresh engagement with the paper web in transit around the rotating wrap roll 11.

The minority KADY MILL discharge flow, which is three to ten times the consumption or make-up flow rate, follows conduit 35 into the suction of pump 36 for delivery through screen supply conduit 37 to a continuously cleaned, atmospherically open, fine mesh screen 38. Although there are numerous suitable styles and designs, an acceptable example is that known to the trade as a Sweco. Here, the screen clothing 45 may be of the order of 250 to 400 Tyler mesh and dynamically driven to vibrate the reject material to the outer screen perimeter for discharge from the system via conduit 43.

Accepted material which passes through the screen clothing 45 is funneled into conduit 40 for return to the KADY MILL inlet.

Conduit 42 provides a sewer drain for periodic equipment cleaning and conduit 41 selectively shunts the open screen flow directly to the dispersion unit 16 inlet.

Misting sprays 47 provide a continuous flow of make-up water while showers 46 periodically flush the screen cloth 45 of trapped accumulations.

EXAMPLE

In a specific application of the present invention, a 500 gpm total circulation flow of coating fluid as measured at the KADY MILL discharge conduit 17, was divided as described above with 30 gpm channeled to a full flow Sweco screen having 325 Tyler mesh clothing (44 micron) vibrated at 2,200 cpm over a 1/32 in. amplitude. The remaining 470 gpm coating fluid flow was parallel divided between two pressure screens with 150 Tyler mesh screen sock clothing (105 micron) each. Make-up flow to this system was about 10 gpm. The Sweco screen 38 loop had been added to a preexisting KADY MILL and pressure screen circulation loop to consummate the present invention.

Figure 2:
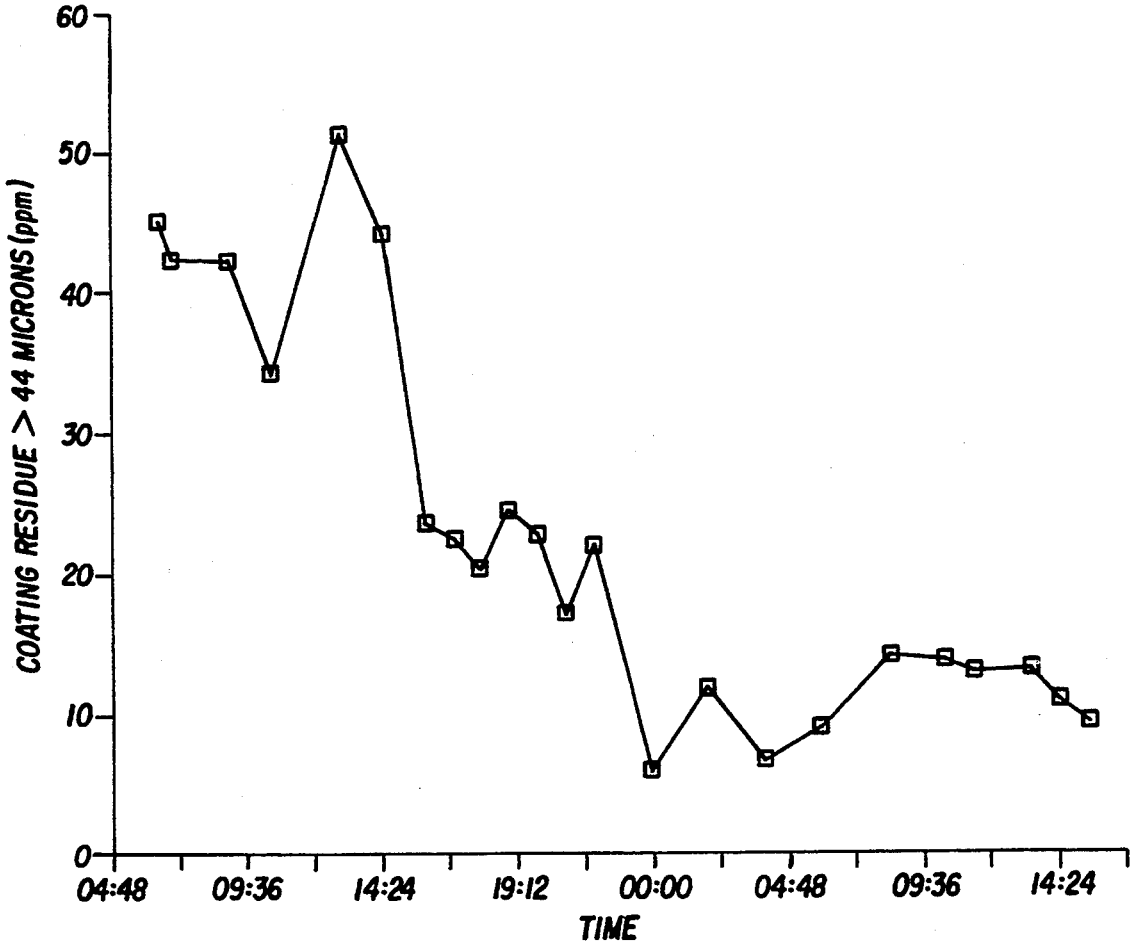
FIG. 2 is a graph of the present invention start-up performance.

From initial start-up of the invention combination and continuing for 36 hours thereafter, coating was sampled periodically at the applicator feed line 29. The results of such sampling are graphed by FIG. 2. Over the first eight hours of operation, the first six samples had an average contamination content of 43 ppm: contamination being defined as a particle size in excess of 44 microns. After 16 hours of operation, contamination leveled off at 11 ppm.

Having therefore fully described our invention, obvious equivalents and variations will readily occur to those of ordinary skill in the art. As our invention, however.

We claim:

1. An apparatus for removing contaminated particles from a fluidized paper web coating material circulation system, said apparatus comprising:

a paper web coating means for coating said web with a coating material;

a particle dispersing means operatively connected to said paper web coating means by a first conduit means such that substantially all of an unconsumed, contaminated coating material flows through said first conduit means to said particle dispersing means;

a pressure screen means operatively connected to said particle dispensing means by a second conduit means such that a majority portion of a coating material flow leaving said particle dispersing means flows through said second conduit means to said pressure screen means; and an open screen means operatively connected to said particle dispensing means by a third conduit means such that a minority portion of said coating material flow leaving said particle dispersing means flows through said third conduit means to said open screen means and said open screen means being operatively connected to a contaminated particle disposal means.

2. The apparatus, as in claim 1, wherein said pressure screen means comprises:

a screen having a mesh size of approximately 100 to 150.

3. The apparatus, as in claim 1, wherein said open screen means comprises:

a screen having a mesh size of approximately 250 to 400.

4. The apparatus, as in claim 1, wherein said particle dispersing means comprises:

a rotor; and a vaned stator located substantially around said rotor.

5. The apparatus, as in claim 1, wherein said open screen means comprises:

a continuously cleaned and atmospherically open screen.

6. The apparatus, as in claim 1, wherein said second conduit means comprises:

a first flow circulation means;

a first valve means operatively connected to said first flow circulation means; and a cooling means operatively connected to said first valve means and said pressure screen means.

7. The apparatus, as in claim 1, wherein said third conduit means comprises:

a second valve means;

a second flow circulation means operatively connected to said second valve means;

a third valve means operatively connected to said second flow circulation means and said open screen means; and a fourth valve means operatively connected to said open screen means and said particle dispersing means.

8. The apparatus, as in claim 1, wherein said open screen means is operatively connected to said contaminated particle disposal means by a fifth valve means.

9. The apparatus, as in claim 1, wherein said apparatus comprises:

a contaminated particle receptacle means located adjacent to said open screen means and operatively connected to said contaminated particle disposal means.

10. The apparatus, as in claim 9, wherein said contaminated particle receptacle means comprises:

a reject trough.

11. The apparatus, as in claim 9, wherein a sixth valve means is substantially located between said contaminated particle receptacle means and said contaminated particle disposal means.

12. The apparatus, as in claim 5, wherein said open screen comprises:

a misting means located substantially above said open screen for misting a liquid on said open screen; and a shower means located substantially above said open screen to shower a liquid on said open screen.

13. A method for removing contaminated particles from a circulation system for a fluidized paper web coating material comprising the steps of: providing a fluidized paper web coating material circulation system, said system including a paper web coating means, a particle dispersing means, a pressure screen means, an open screen means and first, second and third conduit means:

contacting a paper web with a paper web coating material in said paper web coating means;

collecting an amount of said paper web coating material which is contaminated and not consumed by said paper web in said paper web coating means;

transporting contaminated coating material to said particle dispersing means along said first conduit means;

dispersing contaminates located within said contaminated coating material by said particle dispersing means to produce a first cleaned coating;

transporting a majority portion of said first cleaned coating to said pressure screen means along said second conduit means;

cleaning said first cleaned coating in said pressure screen means to produce a second cleaned coating;

transporting said second cleaned coating from said pressure screen means to said paper web coating means;

transporting a minority portion of said first cleaned coating to said open screen means along said third conduit means;

cleaning said first cleaned coating in said open screen means to produce a third cleaned coating;

transporting said third cleaned coating from said open screen means to said particle dispersing means; and transporting substantially any contaminants removed from said first cleaned coating by said open screen means to a contaminant disposal means.

14. The method, as in claim 13, wherein said step of cleaning said first cleaned coating in said pressure screen means further comprises the step of:

screening said first cleaned coating across a screen having a screen mesh size of approximately 100 to 150.

15. The method, as in claim 13, wherein said step of cleaning said first cleaned coating in said open screen means further comprises the step of:

screening said first cleaned coating across a screen having a screen mesh size of approximately 250 to 400.

16. The method, as in claim 13, wherein said step of dispersing said contaminants in said particle dispersing means further comprises the step of:

aerating said contaminated coating.

17. The method, as in claim 13, wherein said step of cleaning said first cleaned coating in said pressure screen means further comprises of the step of:

aerating said contaminated coating.

18. The method, as in claim 13, wherein said step of transporting a minority portion of said first cleaned coating is equal in volume to approximately 3 to 10 times an amount of said paper web coating material which is consumed by said paper web.

* * * * *